United States Patent [19]

Ueda et al.

[11] Patent Number: 4,766,751

[45] Date of Patent: Aug. 30, 1988

[54] APPARATUS FOR CONTINUOUSLY PRODUCING TUBE HAVING HELICAL GROOVES IN ITS INNER SURFACE

[75] Inventors: Iwao Ueda, Izumi; Sukimoto Minobu, Sakai, both of Japan

[73] Assignee: Hamana Iron Works Co., Ltd., Izumi, Japan

[21] Appl. No.: 36,055

[22] Filed: Apr. 9, 1987

[30] Foreign Application Priority Data

Apr. 10, 1986 [JP] Japan ..... 61-83388

[51] Int. Cl.[4] ..... B21B 15/02

[52] U.S. Cl. ..... 72/64; 72/371; 72/299; 72/181; 72/65

[58] Field of Search ..... 72/64, 65, 371, 299, 72/369, 181; 57/58.3, 58.32, 58.38

[56] References Cited

U.S. PATENT DOCUMENTS

| | | | |
|---|---|---|---|
| 1,740,612 | 12/1929 | Lowe | 72/65 |
| 1,998,582 | 4/1935 | Jensen | 72/64 |
| 2,250,610 | 7/1941 | Simons | 72/64 |
| 2,289,398 | 7/1942 | Whist | 72/64 |
| 3,375,690 | 4/1968 | Fink | 72/371 |
| 4,367,641 | 1/1983 | Mitzutani | 72/64 |

FOREIGN PATENT DOCUMENTS

| | | | |
|---|---|---|---|
| 58-212815 | 12/1983 | Japan | 72/64 |
| 0212816 | 12/1985 | Japan | 72/181 |

*Primary Examiner*—David Jones

*Attorney, Agent, or Firm*—Armstrong, Nikaido, Marmelstein & Kubovcik

[57] ABSTRACT

An apparatus for continuously producing a tube having helical grooves in its surface comprises a first drum, a flier having an axis intersecting the axis of the first drum at right angles therewith and rotatable around the first drum, and a second drum. One of the two drums serves as a pay-off drum for paying off a tube having straight grooves in its inner surface, while the other drum serves as a take-up drum for winding thereon the helically grooved tube obtained. At one side of the pay-off drum where the paid-off straight-grooved tube is to be transferred to the flier, a device is provided for preventing the torsion of the tube produced by the rotation of the flier from being transmitted toward the pay-off drum. A correcting device is provided between the flier and the take-up drum for remedying deformation of the helically grooved tube. With the rotation of the flier, the straight-grooved tube is twisted, whereby the straight grooves are deformed to helical grooves to afford a helically grooved tube.

8 Claims, 2 Drawing Sheets

APPARATUS FOR CONTINUOUSLY PRODUCING TUBE HAVING HELICAL GROOVES IN ITS INNER SURFACE

BACKGROUND OF THE INVENTION

The present invention relates to an apparatus for continuously producing a tube having helical grooves in its inner surface and useful chiefly as a refrigerant tube for heat exchangers.

Tubes having helical grooves in the inner surface, when used as refrigerant tubes, assure heat exchange between the refrigerant passing through the tube and the outside air with a higher efficiency than is achieved by usual tubes, so that these grooved tubes are advantageous for producing heat exchangers of reduced size with use of reduced quantities of materials. An apparatus for producing such a tube internally having helical grooves has already been proposed in Unexamined Japanese Patent Publication No. 212815/83. This conventional apparatus comprises a first drum, a cradle supporting the shaft of the first drum, a flier having an axis intersecting the axis of the first drum at right angles therewith and rotatable around the first drum, and a second drum. One of the two drums serves as a pay-off drum for paying off a tube having straight grooves in at least one of its inner and outer surfaces, while the other drum serves as a take-up drum for winding thereon the helically grooved tube obtained. With the rotation of the flier, the straight-grooved tube is twisted, whereby the straight grooves are deformed to helical grooves.

The conventional apparatus has the likelihood that when the tube is twisted, the torsion will be transmitted toward the pay-off drum. The torsion, if transmitted toward the pay-off drum, produces variations in the twist angle of the grooves and hinders smooth tube paying-off operation. Further if the tube has an eccentric wall and is twisted, it is likely that the tube will become deformed or flattened.

SUMMARY OF THE INVENTION

The main object of the present invention is to overcome the above problem and to provide an apparatus for continuously producing a tube having helical grooves in its inner surface. The apparatus comprises a first drum, a cradle supporting the shaft of the first drum, a flier having an axis intersecting the axis of the first drum at right angles therewith and rotatable around the first drum, a second drum, one of the two drums serving as a pay-off drum for paying off a tube having straight grooves in its inner surface, the other drum serving as a take-up drum for winding thereon the helically grooved tube obtained, preventing means disposed at one side of the pay-off drum where the paid-off straight-grooved tube is to be transferred to the flier for preventing the torsion of the tube produced by the rotation of the flier from being transmitted toward the pay-off drum, and correcting means provided between the flier and the take-up drum for remedying deformation of the helically grooved tube. With the rotation of the flier, the straight-grooved tube is twisted, whereby the straight grooves are deformed to helical grooves to afford a helically grooved tube. With the apparatus of the present invention, there is no likelihood that the torsion of the tube will be transmitted toward the pay-off drum. This obviates variations in the twist angle of the grooves and assures a smooth tube paying-off operation. Further even if the tube is deformed or flattened by twisting, the correcting means eliminates such deformation, permitting the tube to be restored its circular cross section. Thus, the apparatus produces no rejects.

The invention will be described in greater detail with reference to the accompanying drawings.

DESCRIPTION OF THE PREFERRED EMBODIMENT

Figure 1:
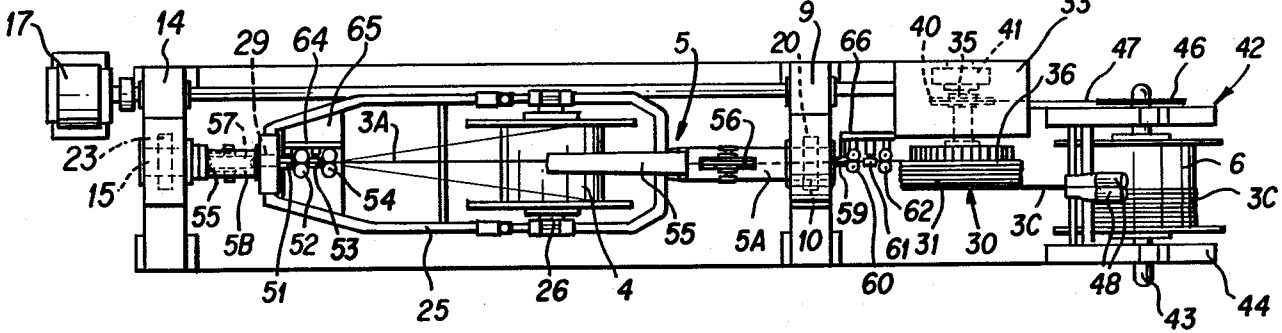
FIG. 1 is a plan view showing an apparatus embodying the invention for continuously producing a tube having helical grooves in its inner surface.
Figure 2:
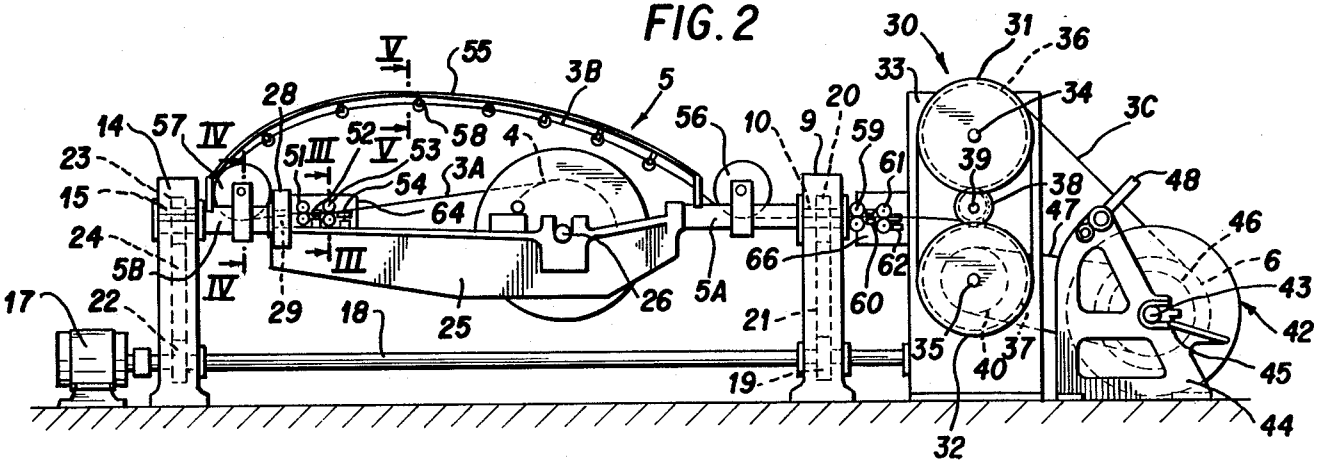
FIG. 2 is a side elevation showing the apparatus of FIG. 1.

The term "front" or "forward" as used herein refers to the direction of feed of the tube, i.e. to the right-hand side of FIGS. 1 and 2.

Figure 6:
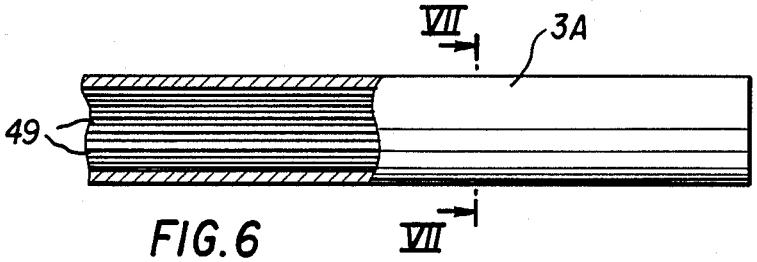
FIG. 6 is an enlarged fragmentary side elevation partly broken away and showing a tube having straight grooves in its inner surface.
Figure 7:
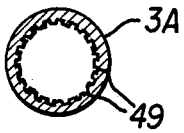
FIG. 7 is a view in section taken along the line VII—VII in FIG. 6.
Figure 8:
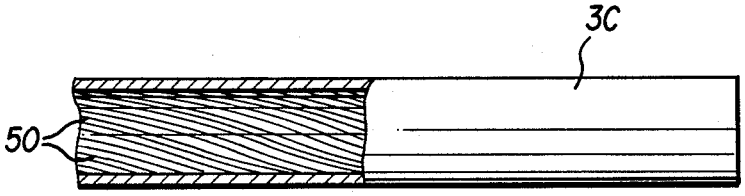
FIG. 8 is an enlarged fragmentary side elevation partly broken away and showing the helically grooved tube.

The apparatus of the present invention is adapted to continuously produce a tube 3C having a multiplicity of helical grooves 50 in its inner surface (see FIG. 8) from a tube 3A prepared by extrusion and having straight grooves 49 in its inner surface (see FIGS. 6 and 7). With reference to FIGS. 1 to 5, the apparatus comprises a first drum 4, a cradle 25 supporting the shaft 26 of the first drum 4, a flier 5 having an axis intersecting the axis of the first drum 4 on the cradle 25 at right angles therewith and rotatable around the first drum 4, and a second drum 6. The first drum 4 serves as a pay-off drum for paying off the straight-grooved tube 3A, while the second drum 6 serves as a take-up drum for winding thereon the helically grooved tube 3C obtained. At one side of the pay-off drum where the paid-off straight-grooved tube 3A is to be transferred to the flier 5, first to fourth catching rollers 51 to 54 are arranged as means for preventing the torsion of the tube produced by the rotation of the flier 5 from being transmitted toward the pay-off drum. Fifth to eighth catching rollers 59 to 62 are provided between the flier 5 and the take-up drum as correcting means for remedying deformation of the helically grooved tube 3C.

To guide the tube over one-half of the periphery of the first drum 4, the flier 5 comprises a tubular front member 5A, a tubular rear member 5B spaced apart from the member 5A by a predetermined distance, and an archlike guide member 55 interconnecting the front member 5A and the rear member 5B. The front member 5A is formed in its top portion with a slit extending longitudinally thereof and has a large front guide roller 56 partly inserted into the horizontal hollow portion of the member from above through the slit, whereby the tube is led into the hollow portion horizontally. The slit of the front member 5A is similar to a slit 67 formed in the rear member 58 shown in FIG. 4. The slit 67 is formed in the top portion of the rear member 5B and extends longitudinally thereof. A large rear guide roller 57 is partly inserted into the horizontal hollow portion of the member from above through the slit 67, whereby the tube is led out from the hollow portion and upwardly folded over (see FIG. 4). The archlike guide member 55 is provided on its underside with a multiplicity of small guide roller 58s arranged in a row longitudinally thereof (see FIGS. 2 and 5). The front member 5A has a hollow rotary shaft 10 supported by a bearing housed in an upper portion of a front stand 9. The rear member 5B has a rotary shaft 15 supported by a bearing housed in a rear stand 14. The rear stand 14 pairs with the front stand 9. An electric motor 17 for rotating the flier 5 is disposed behind the lower end of the rear stand 14 toward its one side. The output shaft of the motor 17 is coupled to a drive shaft 18, which is supported by bearings housed in the lower ends of the front and rear stands 9, 10. The front end of the drive shaft 18 and the front rotary shaft 10 of the flier 5 are provided respectively with pulleys 19, 20, around which a timing belt 21 is reeved. Pulleys 22, 23 are mounted on the rear end of the drive shaft 18 and the rear rotary shaft 15 of the flier 5, respectively. A timing belt 24 is reeved around these pulleys 22, 23. These pulleys and belts are housed in the stands.

The cradle 25, which is stationary and in the form of an approximately rectangular frame, is provided between the front member 5A and the rear member 5B of the flier 5 and is attached thereto as supported by bearings. The shaft 26 of the first drum 4 is supported at its opposite ends by the cradle 25, as positioned slightly forwardly of the longitudinal midportion of the cradle. A tube passing bore 29 horizontally extends through an upright rear wall 28 of the cradle 25.

A capstan 30, which is driven in synchronism with the flier 5, is disposed in front of the front stand 9 toward one side thereof. The capstan 30 has a pair of upper and lower winding drums 31, 32 and is attached by horizontal shafts 34, 35 to one side of a hollow box 33 which is higher than the front stand 9. Each of the winding drums 31, 32 has a plurality of helical grooves for the tube to correctly pass around the drum. The two winding drums are spaced apart by a small distance. Between the winding drums 31, 32 and the hollow box 33, large gears 36, 37 are mounted on the horizontal shafts 34, 35, respectively. A pinion 38 is disposed between the two gears 36, 37 in meshing engagement therewith and has a hollow shaft 39 extending into the hollow box 33. A sprocket wheel 40 is mounted on the horizontal shaft 35 at its outer shaft end, which is opposed to a friction clutch 41 which effects or interrupts torque transmission to a winch 42. Disposed in the hollow box 33 are change gears for changing the speed of rotation of the flier 5 or the capstan 30 so as to vary the twist angle of the tube as desired. The change gears may be replaced by a stepless speed change device. The upper end of the lower winding drum 32 is approximately at the same level as the position of the tube which has horizontally passed through the hollow rotary shaft 10 on the front stand 9 after having been led into the front member 5A of the flier 5.

The winch 42 is provided with the second drum 6. The shaft 43 of the drum 6 is supported by bearings 45 on a stand 44. An endless chain 47 is reeved around the sprocket wheel 40 within the hollow box 33 and a sprocket wheel 46 mounted on one end of the shaft 43. Mounted on the upper end of the stand 44 are a pair of horizontally movable guide rollers 48 for nipping the tube 3C from opposite sides and guiding the tube so that the tube will be wound on the second drum 6 helically and closely from one side thereof toward the other side. The tension on the tube to be wound on the second drum 6 is adjusted by controling the torque by the friction clutch 41, while a torque motor may be used.

Figure 3:
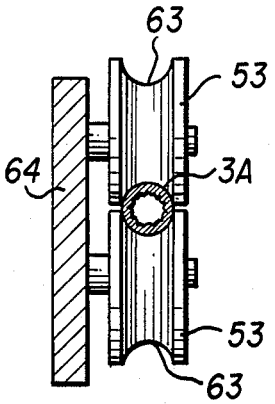
FIG. 3 is an enlarged view in section taken along the line III—III in FIG. 2.
Figure 4:
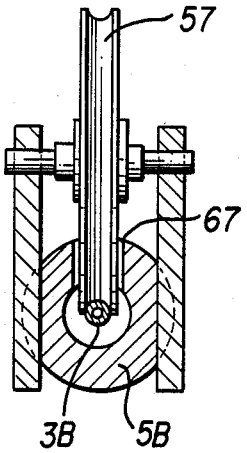
FIG. 4 is an enlarged view in section taken along the line IV—IV in FIG. 2.
Figure 5:
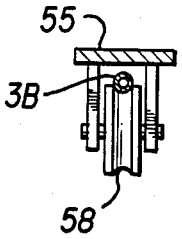
FIG. 5 is an enlarged view in section taken along the line V—V in FIG. 2.

Each of the first to fourth catching rollers 51 to 54 and the fifth to eighth catching rollers 59 to 62 is formed in its peripheral surface with a groove 63 of a semicircular cross section which corresponds to approximately one-half of the outer periphery of the tube (see FIG. 3). The first and third catching rollers 51, 53 are mounted on a vertical plate 64, with their shafts positioned horizontally. The second and fourth catching rollers 52, 54 are mounted on a horizontal plate 65, with their shafts positioned vertically. The horizontal plate 65 is provided on the cradle 25, while the vertical plate 64 extends upward from the horizontal plate 65. The fifth and seventh catching rollers 59, 61 are mounted on a vertical plate 66, with their shafts positioned horizontally, and the sixth and eighth catching rollers 60, 62 are also mounted on the plate 66, with their shafts positioned vertically. The vertical plate 66 is attached to the hollow box 33 and extends rearward therefrom, permitting the fifth to eighth catching rollers 59 to 62 to catch the tube 3B as it is sent out from the flier 5.

With the above apparatus, an internally straight-grooved tube 3A is paid off from the first drum 4, then temporarily nipped between the first to fourth catching rollers 51 to 54, thereafter passed through the horizontal hollow portion of the rear member 5A of the flier 5, guided by the archlike guide member 55 and led into the horizontal hollow portion of the front member 5A. The tube sent out from this portion is temporarily catched by the fifth to eighth catching roller 59 to 62, by which deformation, if any, is remedied, whereupon the tube is sent to the capstan 30. In the meantime, the flier 5 is rotated by the motor 17, and the tube 3B is twisted two turns between the guiding start end of the rear member 5A and the guiding terminal end of the front member 5A. By being thus twisted, the straight grooves 49 of the tube 3A are deformed to helical grooves 50, whereby a helically grooved tube 3C is obtained. The tube 3C is passed around the lower winding drum 32 of the capstan 30 and then around the upper winding drum 31 and thereafter wound on the second drum 6 of the winch 42. During this travel, the first to fourth cataching rollers 51 to 54 prevent the torsion of the tube produced by the rotation of the flier 5 from being transmitted toward the first drum 4. As the tube 3C is wound on the second drum 6, the thickness of the layer of tube on the second drum 6 increases, giving a higher traveling speed to the tube and resulting in a reduced twisting pitch. However, adjustment is made by the capstan to maintain the tube at a constant traveling speed.

The twist angle of the grooves is dependent on the speed of rotation of the flier 5 and the speed of rotation of the capstan 30. For example, when the former speed is constant, the latter speed, if increased, results in a smaller twist angle. Accordingly, the transmission means to be used is such as to give the desired twist angle.

The tube to be wound around the first drum 4 is an aluminum extrudate having a multiplicity of straight grooves formed in its inner surface by extrusion. However, the material is not limited to aluminum but can be copper, soft steel or the like. Further the tube is not limited to one having straight grooves in its inner surface only as seen in FIGS. 6 and 7; an aluminum extrudate having straight grooves in both the inner and outer surfaces can be made into a tube having helical grooves in its inner and outer surfaces.

In the foregoing embodiment, the first drum 4 serves as a pay-off drum for paying off the straight-grooved tube 3A, and the second drum 6 serves as a take-up drum for winding the helically grooved tube 3C thereon. Conversely, however, the second drum 6 may be used as the pay-off drum, and the first drum 4 having its shaft 26 supported on the cradle 25, as the take-up drum, with the tube traveled in a direction opposite to the direction indicated by an arrow in FIG. 2, whereby the same result as above can be achieved. In this case, the fifth to eighth catching rollers 59 to 62 act as means for preventing the torsion produced by the rotation of the flier 5 from being transmitted toward the pay-off drum, while the first to fourth catching rollers 51 to 54 serve as correcting means. In the foregoing embodiment, a plurality of pairs of catching rollers are arranged as the preventing means, and the adjacent roller pairs differ from each other by 90 degrees in the orientation of their shafts. This arrangement is desirable since the catching rollers for holding the tube also act to remedy deformation of the tube. However, the tube can be twisted satisfactorily by one pair of catching rollers. Use of the catching roller is not limitative. Like the preventing means, at least one pair of catching rollers may be used as the correcting means, which nevertheless need not always be catching rollers.

What is claimed is:

1. An apparatus for continuously producing a tube having helical grooves in its inner surface comprising a first drum having a shaft and being for paying off a tube having straight grooves in its inner surface, a stationary cradle supporting the shaft of the first drum, a flier having an axis intersecting the axis of the first drum at right angles therewith and rotatable around the cradle for twisting the tube, a second drum positioned adjacent said flier and said first drum and serving as a take-up drum for winding thereon the helically grooved tube obtained through rotation of the flier, a capstan disposed between said flier and said second drum, preventing means mounted on said cradle disposed at one side of the pay-off drum where the paid-off straight-grooved tube is to be transferred to the flier for preveting the torsion of the tube produced by the rotation of the flier from being transmitted toward the pay-off drum, and correcting means provided between the flier and the capstan for remedying any undesired cross-sectional deformation of the helically grooved tube that may have occurred during rotation of said flier.

2. An apparatus as defined in claim 1 wherein the preventing means comprises at least one pair of opposedly positioned catching rollers, each of the catching rollers being formed in its peripheral surface with a groove of semicircular cross-section which corresponds to approximately one-half of the outer periphery of the tube.

3. An apparatus as defined in claim 1 wherein the correcting means comprises at least one pair of opposedly positioned catching rollers, each of the catching rollers being formed in its peripheral surface with a groove of semicircular cross-section which corresponds to approximately one-half of the outer periphery of the tube.

4. An apparatus as defined in claim 1 wherein each of the preventing means and the correcting means comprises pairs of catching rollers having adjacent roller pairs differing from each other by 90 degrees in the orientation of their shafts.

5. An apparatus as defined in claim 1 wherein the flier comprises a tubular front member, a tubular rear member spaced apart therefrom by a predetermined distance, and an archlike guide member interconnecting the front member and the rear member so as to guide the tube over one-half of the periphery of the first drum.

6. An apparatus as defined in claim 5 wherein each of the front member and the rear member has in its top portion a slit extending longitudinally thereof, and a guide roller is partly inserted in the horizontal portion of the tubular member through the slit.

7. An apparatus as defined in claim 5 wherein the archlike guide member is provided on its underside with a multiplicity of guide rollers arranged in a row longitudinally thereof.

8. An apparatus as defined in claim 6 wherein said apparatus further comprises a front stand having an upper portion and being interposed between said first and second drums, and a rear stand positioned on a side of said first drum away from said second drum, and the front member has a hollow rotary shaft supported by a bearing housed in said upper portion of said front stand, and the rear member has a rotary shaft supported by a bearing housed in said rear stand, the rear stand pairing with the front stand.

* * * * *

UNITED STATES PATENT AND TRADEMARK OFFICE

CERTIFICATE OF CORRECTION

PATENT NO. : 4,766,751

DATED : August 30, 1988

INVENTOR(S) : Iwao UEDA et al

It is certified that error appears in the above-identified patent and that said Letters Patent is hereby corrected as shown below:

On the cover page, Item [75], "Sukimoto Minobu" should read --Minobu Sukimoto--;

Signed and Sealed this

Eighth Day of August, 1989

*Attest:*

*Attesting Officer*

DONALD J. QUIGG

*Commissioner of Patents and Trademarks*